US006902448B2

(12) United States Patent
Wilson

(10) Patent No.: US 6,902,448 B2
(45) Date of Patent: Jun. 7, 2005

(54) MARINE PROPULSION UNIT

(76) Inventor: Jim Wilson, 308 Lakeforest Dr., Waterford, MI (US) 48327

( * ) Notice: Subject to any disclaimer, the term of this patent is extended or adjusted under 35 U.S.C. 154(b) by 0 days.

(21) Appl. No.: 10/476,951

(22) PCT Filed: May 8, 2002

(86) PCT No.: PCT/US02/14683

§ 371 (c)(1),
(2), (4) Date: May 11, 2004

(87) PCT Pub. No.: WO02/090179

PCT Pub. Date: Nov. 14, 2002

(65) Prior Publication Data

US 2004/0198107 A1 Oct. 7, 2004

Related U.S. Application Data

(60) Provisional application No. 60/289,352, filed on May 8, 2001.

(51) Int. Cl.[7] ..... B63H 1/14
(52) U.S. Cl. ..... 440/49; 440/54; 440/75
(58) Field of Search ..... 440/112, 51, 54, 440/56, 58, 59, 60, 61, 75, 49, 53

(56) References Cited

U.S. PATENT DOCUMENTS 3,223,067 A * 12/1965 Horan ..... 440/53
3,626,467 A * 12/1971 Mazziotti ..... 440/61 R
3,685,368 A * 8/1972 Thoma ..... 74/410
5,643,026 A * 7/1997 Pietsch et al. ..... 440/112

* cited by examiner

*Primary Examiner*—Jesus D. Sotelo
(74) *Attorney, Agent, or Firm*—Gifford, Krass, Groh, Sprinkle, Anderson & Citkowski, P.C.

(57) ABSTRACT

A marine propulsion unit utilizing a turbine engine is provided as a drop-in module. The propulsion unit includes a base which forms a part of the hull. The propulsion unit includes a drive unit which is mounted to the engine. Both the engine and the drive unit are moved with respect to the hull to change the angle of the propeller with respect to the hull. A hydraulic resistance system is provided to provide resistance to a turbine engine when in an idle condition. An auxiliary power transfer is provided to power an auxiliary genset and power unit. A main electrical power unit having an auxiliary engine is also connected to the power transfer unit. The auxiliary engine may be used to drive the vessel at low speeds and maneuvering conditions. One of the main engines may be used to drive both of the shafts through the power transfer unit.

17 Claims, 10 Drawing Sheets

MARINE PROPULSION UNIT

This application claims the benefit of 60/289,352 filed May 8, 2002.

BACKGROUND OF THE INVENTION

Conventional inboard marine propulsion units utilize a shaft which extends through a packing gland and is angled downwardly and rearwardly and supported under the stern of the hull by a strut. The engine is mounted to the hull. Frequently, a transmission with universal joint is used to compensate for the position of the motor and transmission with respect to the angle of the shaft. It is also known to use outdrive propulsion units with inboard mounted engines. The engine is mounted to the stern and an outdrive is mounted to the transom of the boat. A universal joint connects the engine to the outdrive. The angle of the outdrive propeller may be varied with respect to the angle of the hull. The angle of the outdrive unit can be adjusted to maximize the efficiency of the prop for different speeds and water conditions. It would be desirable to provide an inboard propulsion unit which has the advantages of the outdrive unit which could be used in a variety of applications. Additionally, it would be advantageous to provide an easily installed propulsion system which does not require a universal joint.

SUMMARY OF THE INVENTION

A marine propulsion unit consisting of a drop-in module having an engine and a drive unit is disclosed. The unit is preferably a turbine shaft engine. The drive unit is mounted to extend through a base having an outer surface forming a portion of the hull. In a preferred embodiment, the propulsion unit is pivotally mounted to the base to permit angular positioning of the propeller with respect to the hull. In a first alternative embodiment, the propulsion unit is mounted to extend through the transom of the boat to provide an inboard/outboard application. The drive unit may be equipped with a rudder and steering assembly. The drive unit contains a novel arrangement of gears and shafts to provide a thin profile. A hydraulic resistance circuit provides resistance when the engine is running at an idle. The propulsion unit can be provided with a power transfer device for driving an auxiliary electrical power generator. The power transfer device also permits use of an auxiliary engine from a main electrical power generator to drive one or both of the main propeller shafts. Likewise, one main engine can drive one or both of the shafts. The engine of the electrical power generator can be used to drive the vessel for maneuvering at low speeds through an auxiliary drive shaft.

A second preferred embodiment of the invention includes a drop-in module having a propulsion unit fixedly mounted to the base. A third preferred embodiment of the invention includes a drop-in module having a rudder and steering assembly.

DETAILED DESCRIPTION OF THE PREFERRED EMBODIMENTS

Figure 1A:
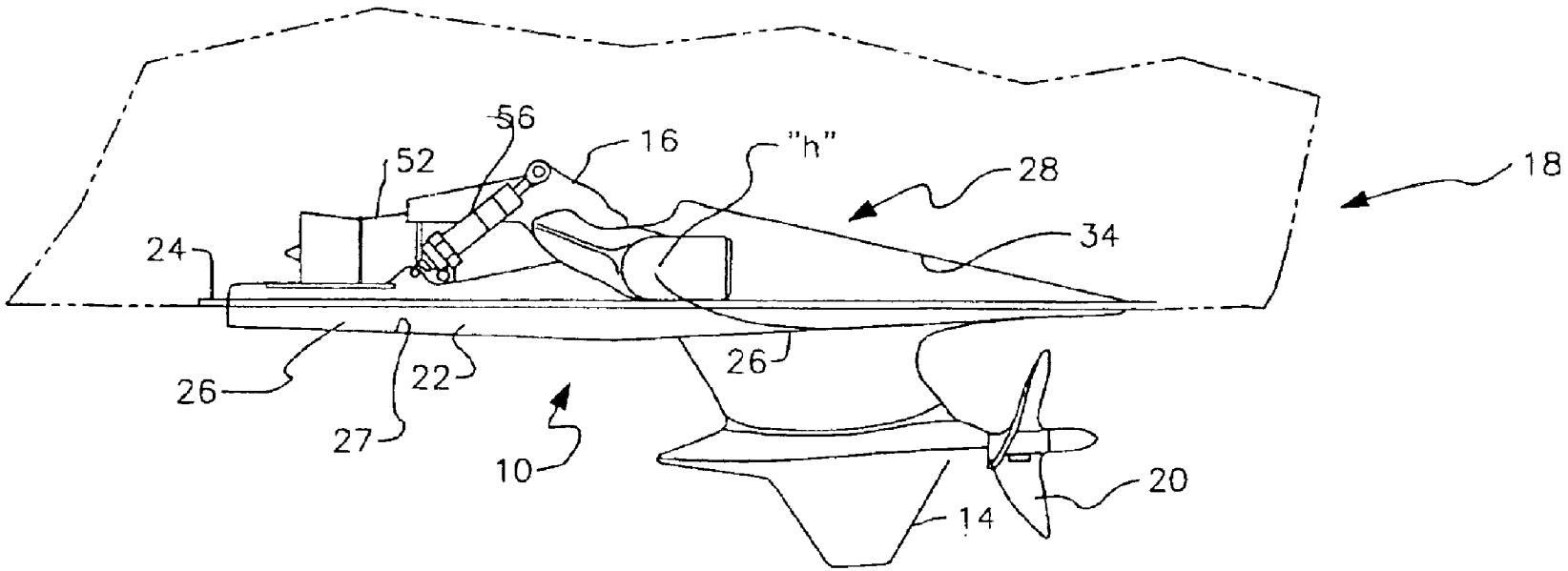
FIG. 1A is a side view of a marine propulsion unit shown in a normal operating position in accordance with the preferred embodiment of the invention.
Figure 1B:
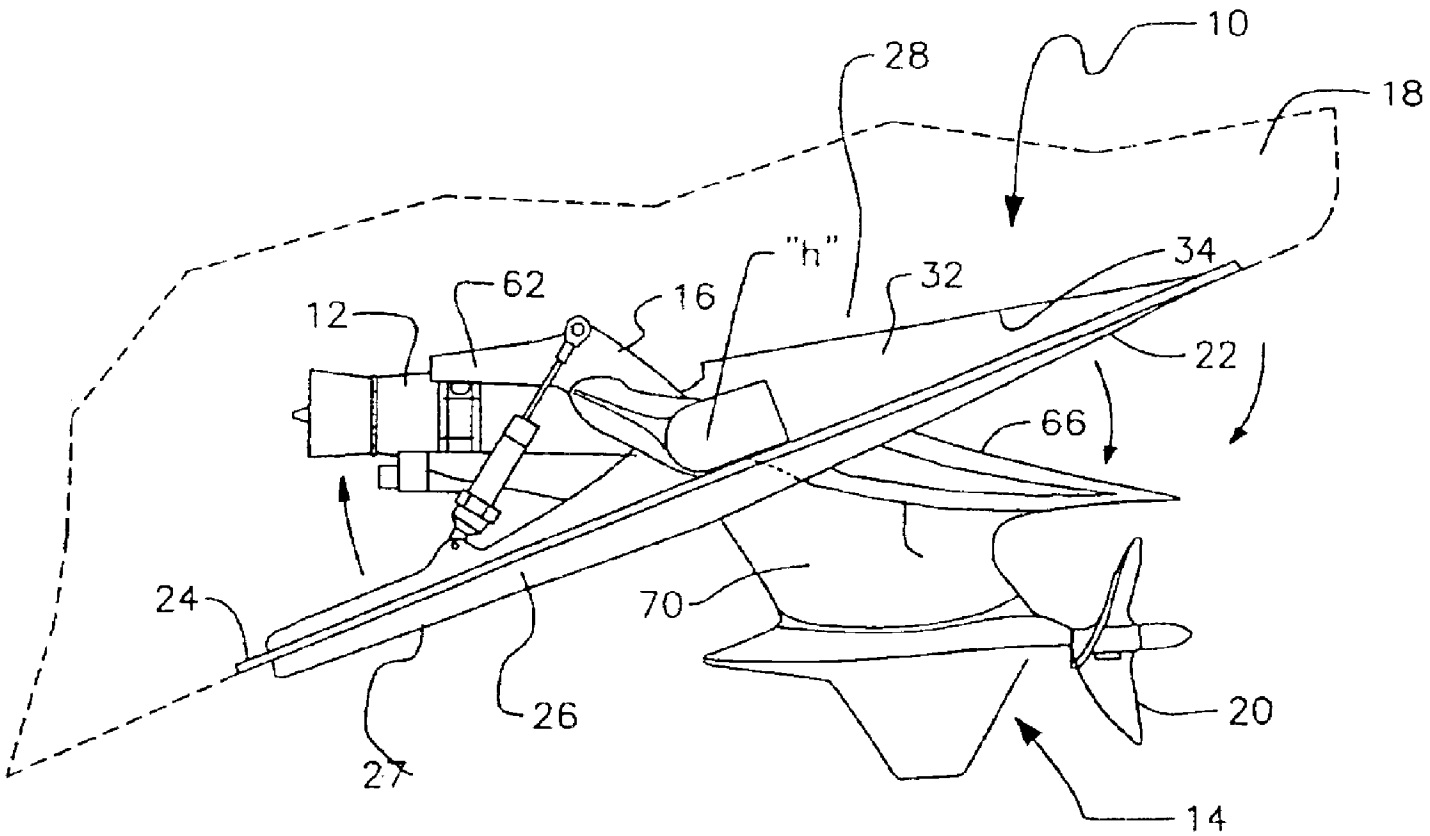
FIG. 1B is a side view of a marine propulsion unit shown in a down position in accordance with the first preferred embodiment of the invention.
Figure 2:
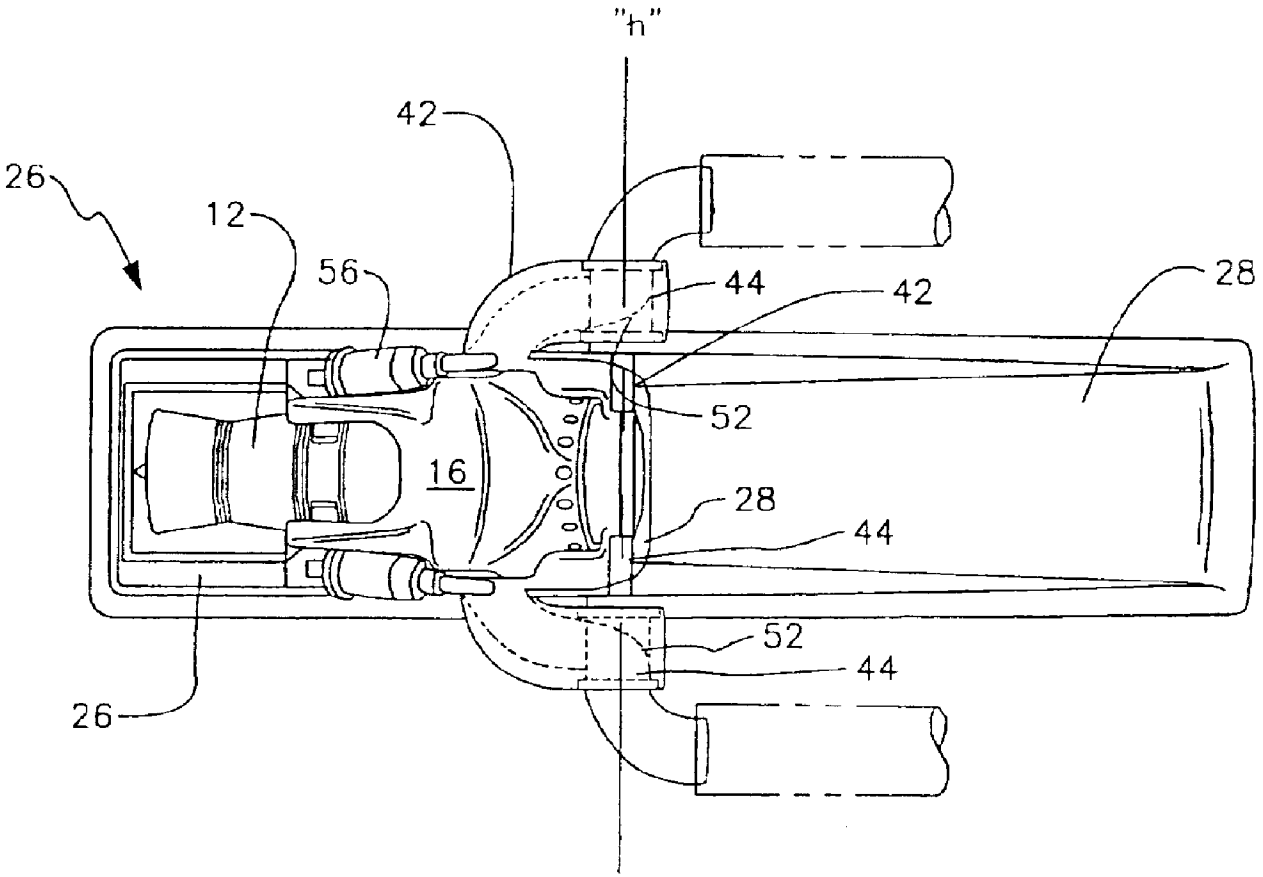
FIG. 2 is a top view of a marine propulsion unit in accordance with the preferred embodiment of the invention.
Figure 3:
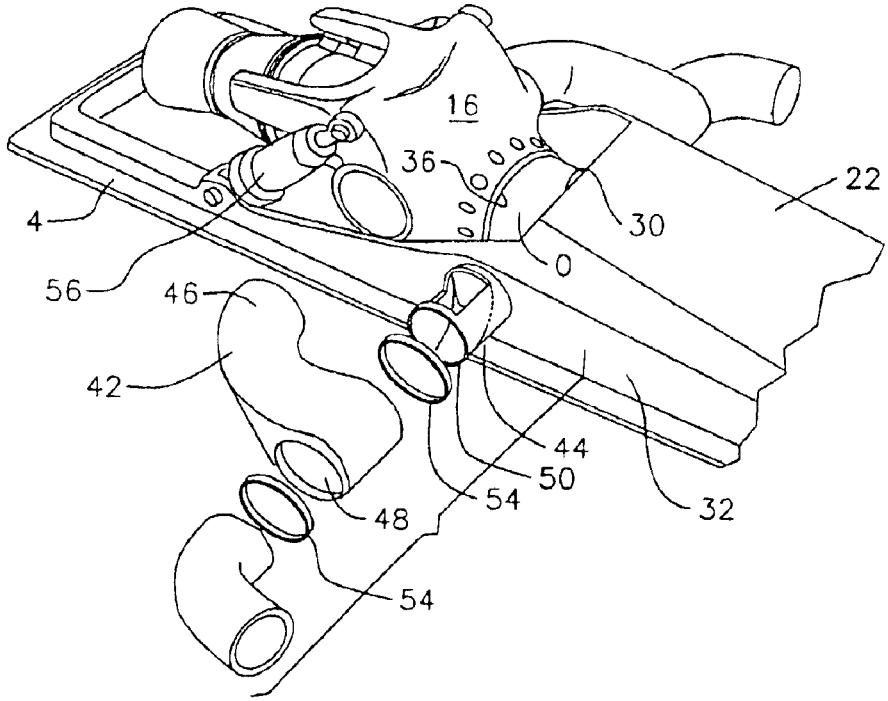
FIG. 3 is an exploded perspective view of a marine propulsion unit shown in accordance with the preferred embodiment of the invention.

A first preferred embodiment of a novel marine propulsion unit 10 which is suitable for inboard applications is shown in FIGS. 1–3. The marine propulsion unit 10 may be easily installed in a boat and is particularly suited for use with turbine engines. However, other types of engines may be used. As best shown in FIGS. 1A and 1B, the propulsion unit 10 includes an engine 12 and a drive unit 14 which are joined together by a cowling 16 and mounted on a base 22. In the preferred embodiment, the propulsion unit 10 is mounted to pivot with respect to base 22. As will be discussed below, the pivotal mounting arrangement permits the angle of a propeller 20 to be adjusted upwardly and downwardly with respect to hull 18 of a boat as shown in FIGS. 1A and 1B.

As shown in FIGS. 1A, 1B, 2 and 3, the propulsion unit 10 and base 22 are mounted as a unit in the hull 18. The hull has a rectangular aperture extending through a bottom of the hull to receive the base 22. The base 22 has a generally rectangular shape having a peripheral flange 24 which is formed to mount the base 22 to an inner surface of the hull. The base 22 is preferably formed of the same material of which the hull is formed, such as fiberglass, composite or aluminum. As shown in FIG. 1A, the base 22 has a forward portion 26 which extends underneath the engine 12 and a tunnel portion 28 which covers a portion of the drive unit 14. The forward portion 26 has a lower surface 27 which is conformed to the shape of the hull 18. The lower surface 27 conforms such that after the base is installed, the lower surface flows continuously with the adjacent portion of the bottom of the hull. The sides of the base 22 closely conform to the shape of the aperture in the bottom of the hull. The tunnel portion 28 has an end wall 30, a pair of side walls 32 and a top wall 34 which form a housing for receiving an upper portion of drive unit 14 when the drive unit is in the fully retracted position.

Figure 5A:
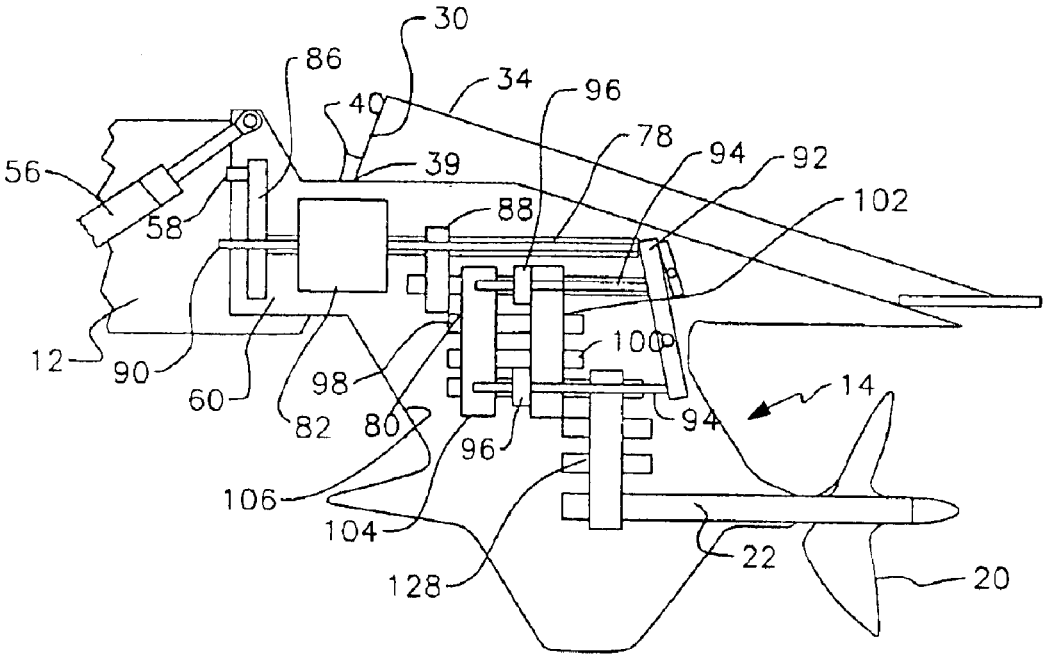
FIG. 5A is a side schematic view of the drive unit in a forward gear in accordance with the preferred embodiment of the invention.

As shown in FIGS. 5A and B, the forward portion of drive unit 14 extends through an aperture 38 formed in the end wall 30. A flexible synthetic boot 40 which has sufficient flexibility to permit pivoting of the propulsion unit extends between the end wall 30 and drive unit 14.

As shown in FIGS. 2 and 3, the propulsion unit 10 is supported for pivotal rotation by a pair of arms 42 which extend between the drive unit 14 and the inner side walls of the base 22 along axis "h". The arms 42 are supported for rotation by bearings and the like which are mounted in the base. Electrical wiring may be carried to the engine through the arms 42. Exhaust is carried from the engine by an L-shaped exhaust tube 43 which is pivotally connected to a sleeve 44. The tubes 43 and sleeves 44 are tubular to form a passage for the exhaust system. Each sleeve 44 extends outwardly from one side wall 32 of the tunnel along the axis "h" which extends transversely across the hull. Each tube has an inner end 46 which passes through the cowling and is mounted to the exhaust ports (not shown) of the engine. Each arm has an outer end having a transverse bore 48 to receive the sleeve 44 therethrough. As shown in FIG. 3, an elongated aperture 50 is formed in the sleeve to extend in an arc to receive exhaust from the tubes 43. An inner surface 52 of the sleeve 44 is radiused to divert the flow of exhaust from the tube smoothly through the sleeve 44 to an exhaust pipe. Seals 54, such as piston rings, are mounted within the transverse bore 48 of the tube 43 to maintain the exhaust within the tubes 43 and sleeve 44.

The inner surface transverse bore 48 of the arm is formed to pivot on the outer surface of the sleeve 44 when the angle of the propeller shaft is adjusted. As shown in FIGS. 1A and 1B, a pair of hydraulic cylinders 56 extend on either side of the engine from the forward portion 26 of the base 22 to the cowling 16. The hydraulic cylinders 56 are moveable to pivot the propulsion unit 10 on the arms 42 to pivot the drive unit 14 and propeller 20 upwardly and downwardly as a unit with respect to the bottom of the hull 18.

As shown in FIGS. 2 and 3, in the preferred embodiment the engine 12 is a turbine engine such as a Pratt and Whitney PT6 with an output shaft 47. However, small gas or electric engines may also be used. Because the engine is lightweight, it may be hard mounted directly to the drive unit without the need for universal joints and the like. The cowling 16 extends between the engine 12 and drive unit 14. The cowling 16 has an aperture 36 formed to receive an input end 60 of the drive unit 14. At the opposite end of the cowling, two arms 62 extend longitudinally to extend above a rear portion of the engine 12. Engine mounting blocks 64 are positioned between ends of each of the arms to mount the engine 12 to the cowling 16.

As shown in FIGS. 1A, 1B, 5A and 5B, the drive unit has a housing 66 with an upper portion 68 which extends through the end wall 30 and into the tunnel 28 and a lower portion 70 which is hydrodynamically formed as a foil to support a propeller shaft 23 and propeller 20 near a lower end. The housing may be formed of metal or a composite material and has removable access covers 74 on the upper portion to permit access to the drive unit. A cavitation plate 76 is formed on the housing 66 to enclose the aperture beneath the tunnel when the propulsion unit is in its fully retracted position, as shown in FIG. 1A. The cavitation plate 76 is radiused longitudinally to provide an upward curve. The curvature of the cavitation plate 76 permits clearance for pivoting of the drive unit with the base 22 and to provide a hydrodynamic flow beneath the tunnel.

Figure 5B:
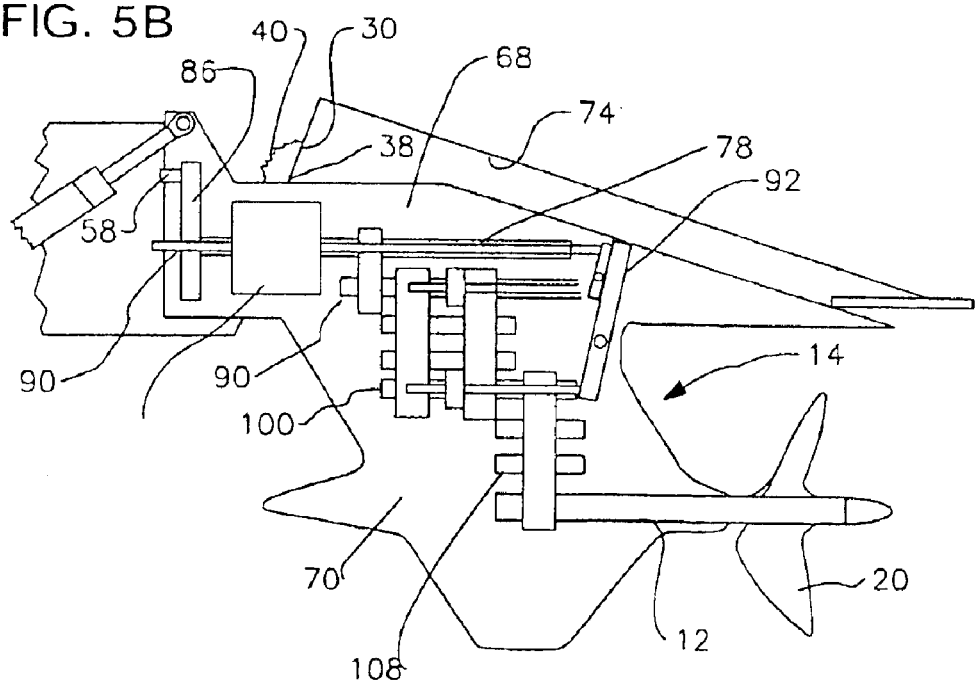
FIG. 5B is a side schematic view of the gearing arrangement as shown in the reverse position.
Figure 6:
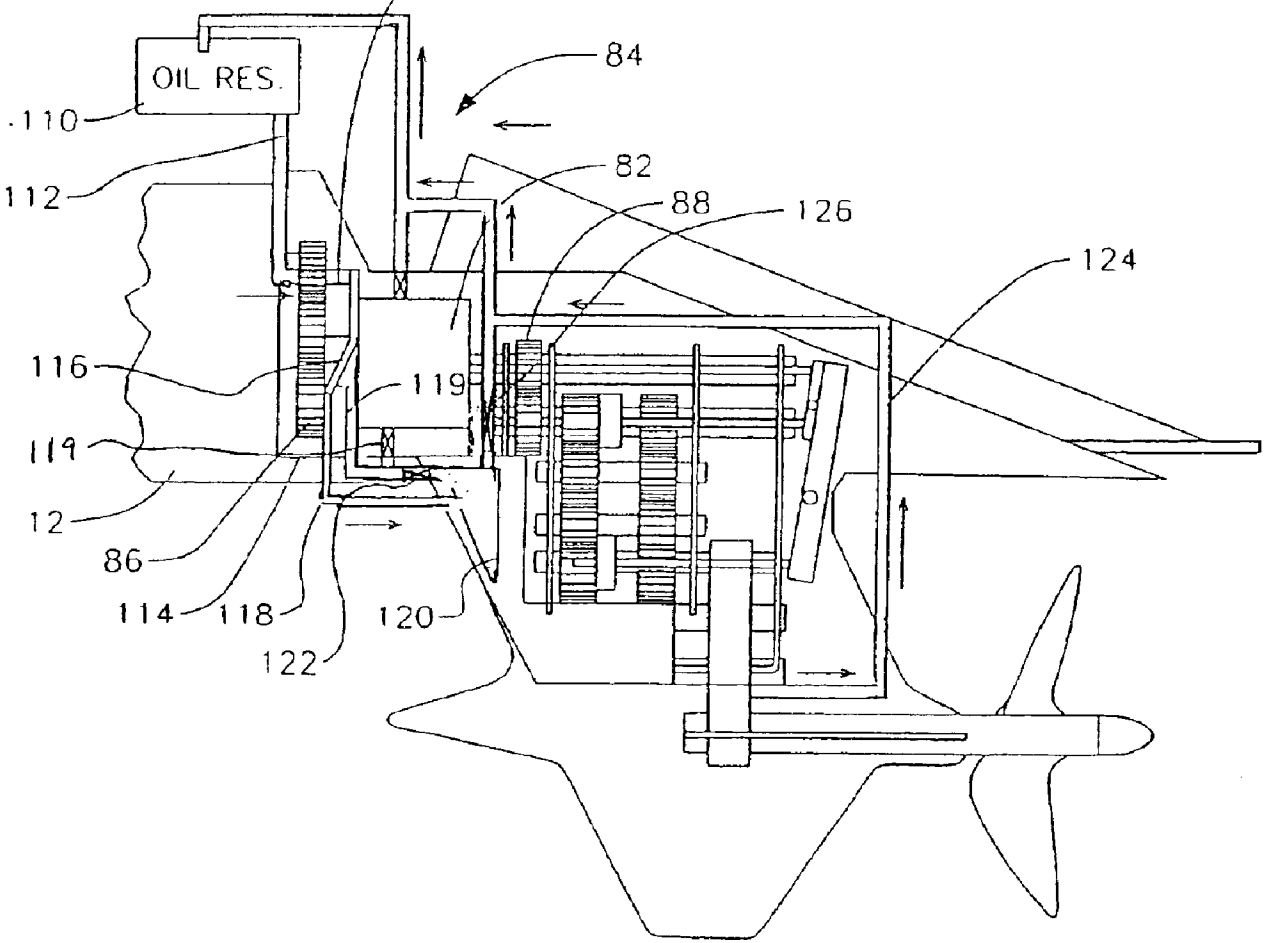
FIG. 6 is a side view of the propulsion unit showing the lubricating and resistance circuit.

As shown in FIGS. 5A, 5B and 6, the upper portion of the drive unit houses an input shaft 78, a shift rod 90, clutch 82, and a hydraulic resistance circuit 84 (FIG. 6) for use when the engine is at idle. The input shaft 78 is connected to a drive shaft 58 of the engine 12 by a pair of reduction gears 86. The main drive shaft 78 extends from the reduction gears 86 to the hydraulic clutch 82 and then to a drive gear 88 for a second reduction. As shown, the input shaft 78 is hollow to receive a shift rod 90 which extends through the drive shaft to a lever arm 92 which is connected to rods 94 connected to clutch dogs 96 on two intermediate shafts 98, 100. The shift rod 90 is formed in segments which are connected with ball bearings and races formed on the ends of the rod to permit relative rotation between the shift rods 90 and the lever arm 92. This is necessary because the shafts carrying the gears are rotating and clearance permits the shift rods to rotate with the gear shafts. The two intermediate shafts 98, 100 are mounted in parallel arrangement between the main input shaft 78 and the propeller shaft. They are connected together by vertical aligned sets of gears 102, 104. One set of gears 102 provides a forward drive and has four gears in a vertical arrangement. The set of reverse gears 104 has five gears, including a reverse gear which is offset on a shaft just beneath the first intermediate shaft 98. The vertical sets of gears are used to provide a very thin side-to-side profile for the foil portion of the housing. Thus, power is transferred downwardly without using large diameter gears. Movement of a shift cam at one end of the main drive shaft engages the hydraulic clutch 82 to drive the main drive shaft 78 and the second driven gears 88. At the same time, the lever arms 92 are moved to move the clutch dogs 96 on the two intermediate shafts 98, 100 to engage one of the two sets of gears 102, 104 corresponding to either forward or reverse direction. These gears then in turn drive the second drive shaft 106 to turn a final set of gears 108 which extends downwardly to connect with the gear mounted on the propeller shaft 23.

As shown in FIG. 6, a hydraulic resistance circuit is formed within the drive unit 14 to provide resistance to the engine 12 when the engine is idle. Turbine engines will accelerate when at idle unless a load is placed on the engine. Hydraulic oil from an oil reservoir 110 is delivered to the first set of reduction gears 86 through conduit 112. The gears 86 are mounted in a housing in the same fashion as a hydraulic gear pump. The hydraulic fluid is pressurized as it passes around the gears 86 and delivered to an outlet 114. A valve 116 is moved by the shift rods 90 between a resistance passage 119 when the engine is at idle and a delivery passage 118 when the drive unit is in gear. This movement of the shift linkage controls gear selection, clutch, clutch dogs, and hydraulic resistance. The pressurized fluid is then delivered through the resistance passage 119 to a restrictor 121 with a pressure relief valve and to the clutch to release the clutch dogs. The fluid is also delivered to a resistance restrictor 122 and to a radiator 120. The resistance restrictor 122 develops resistance in the circuit developing a hydraulic load in opposition to the reduction gear and engine to prevent acceleration when the engine is at idle. However, because the work generated by the resistance in the restrictor 122 causes heat in the hydraulic fluid, fluid is passed through the radiator 120 formed in the lower front portion of the foil to cool the fluid before it is delivered back to the other gears and to the tank. When the gears are engaged and the valve 116 moved, the oil passes through the delivery passage 118 to the radiator 120, the clutch 82 to engage the clutch dogs and through the gear sets. A return passage 124 permits return of the fluid to the reservoir. A pressure relief valve is provided to prevent pressure build up in radiator 120.

Figure 4:
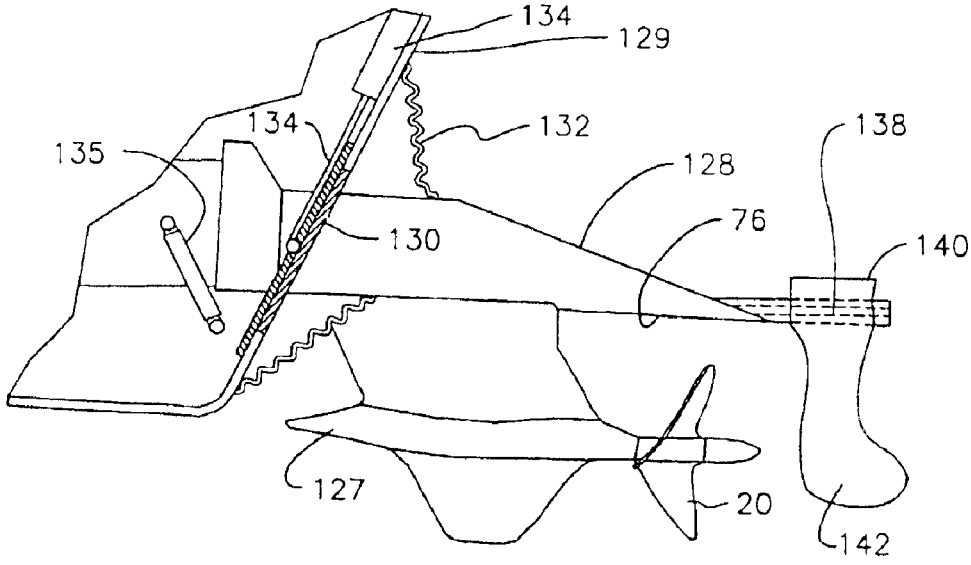
FIG. 4 is a side view of a first alternative embodiment of the invention.

As shown in FIG. 4, a first alternative embodiment of the invention provides a propulsion unit 127 installed for use as an inboard/outboard unit. The propulsion unit 127 is pivotally mounted to the transom 129. The propulsion unit 127 includes the engine 12 and a drive unit 128 as above. As discussed below, the drive unit 128 includes a rudder 142.

Alternatively, the propulsion unit may include drive unit 14 which does not have a rudder. The drive unit 128 extends through a vertically aligned slot 130 in the transom 129 and boot 132. The propulsion unit 127 may be mounted to a vertical lift mechanism on both sides at the pivot axis. A hydraulic cylinder 136 or lead screw arrangement is used to raise or lower a yoke 134 and the propulsion unit 127 within the slot 130. The boot/seal cover 132 permits the propulsion unit to be moved with the slot 130. A pivot mechanism such as a hydraulic cylinder 135 or suitable device is mounted between the yoke 134 and propulsion unit 127 to pivot the propeller 23. Alternatively, propulsion unit 127 may be pivotally mounted directly to the transom without the lift mechanism. In this case the pivot mechanism extends between the transom and propulsion unit.

As shown in FIG. 4, the drive unit 128 may be provided with a rudder 142 which is mounted to extend beneath the end of the cavitation plate 76. The rudder 142 has a longitudinal tongue and groove arrangement 138 to permit the rudder 142 to be slid in for quick change in case of damage or to facilitate performance. A conventional hydraulic steering unit 140 is used to turn the rudder. The drive unit 128 is particularly suited for use with any high performance boat.

Figure 7:
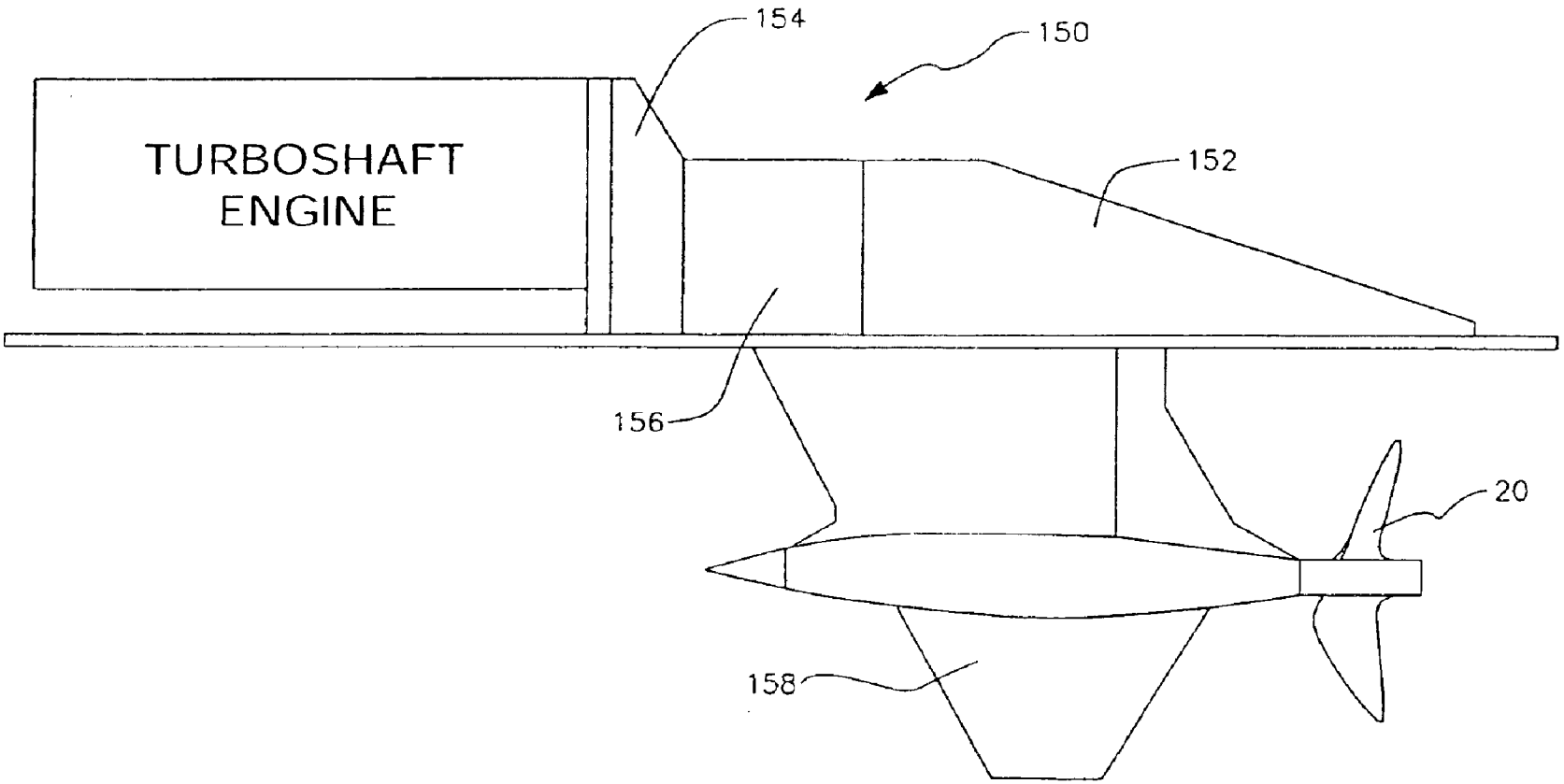
FIG. 7 is a side view of a second alternative preferred embodiment of the invention.

As shown in FIG. 7, a second preferred embodiment of the invention includes a propulsion unit 150 which does not pivot. The engine 12 is connected to a drive unit 152 by the cowling 154 as described above. The drive unit 152 includes a housing 156 and a lower drive unit 158 having a propeller shaft and propeller 20. The housing 156 contains the transmission and parallel gear shaft arrangement discussed above. The fixed propulsion unit 150 is mounted to base 160 by extending the housing 156 through an aperture formed in the base 160 and securing the housing 156 of the drive unit to the interior of the hull.

Figure 8:
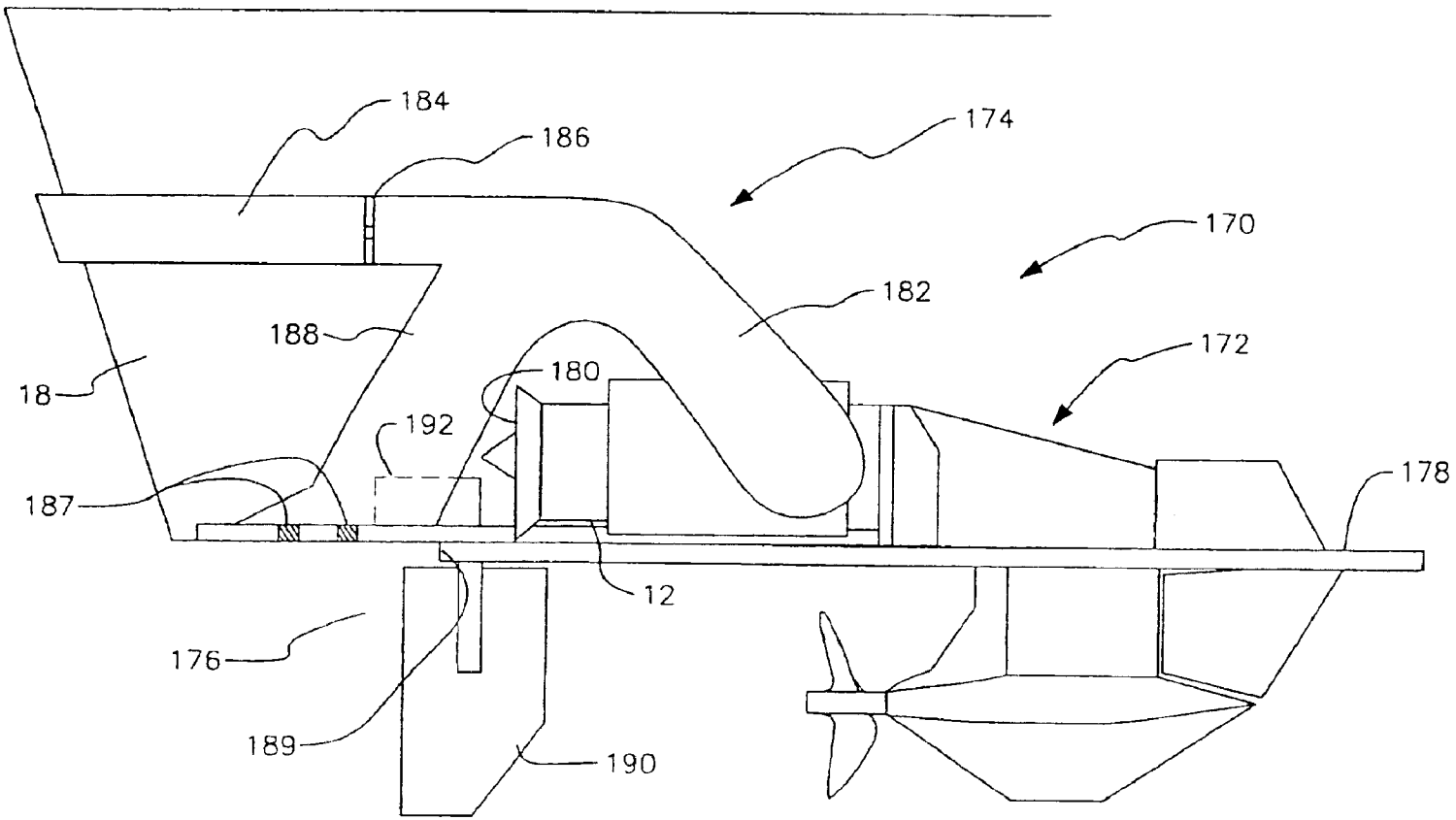
FIG. 8 is a side view of a third preferred alternative embodiment of the invention.

A third preferred alternative embodiment of a propulsion unit is shown in FIG. 8. The propulsion unit 170 includes the turbo shaft engine 12, drive unit 172, exhaust system 174 and a rudder steering assembly 176 mounted to a base 178 to form a "drop-in" module as above. The propulsion unit 170 is compact and lightweight. The engine 12 is mounted to have the air intake 180 open rearwardly and the drive unit 172 forwardly mounted ahead of the engine 12 in reverse of what is disclosed for the propulsion unit 10 described above. Accordingly, the gear setup is such that the propeller shaft and propeller extend in an opposite direction from the drive unit 14 disclosed above. However, the gear arrangement, shift linkage, etc. is the same. The exhaust system 174 includes an exhaust manifold 182 which extends rearwardly and upwardly to an upper exhaust pipe 184 having an idle relief valve 186 for engine start and off plane operation. A main exhaust pipe extends upwardly from the base 178 to the exhaust manifold 182. Exhaust is delivered by ports 187 in the base to the low pressure area behind the rudder 190. The low pressure area is formed by a step 189 in the hull to create a pressure drop in the water flow when the boat is moving sufficiently.

The rudder 190 and steering assembly 192 are mounted to the base 178 so that the engine, drive unit, exhaust system and rudder form a single module which may be dropped into an aperture formed in the hull of the boat. The base 178 has a bottom which is conformed to the exterior shape of the hull as above. After the module is mounted in the boat, the engine is connected to the fuel tankage, electrical power and control system, coolant, etc. which are installed in the boat.

Figure 9:
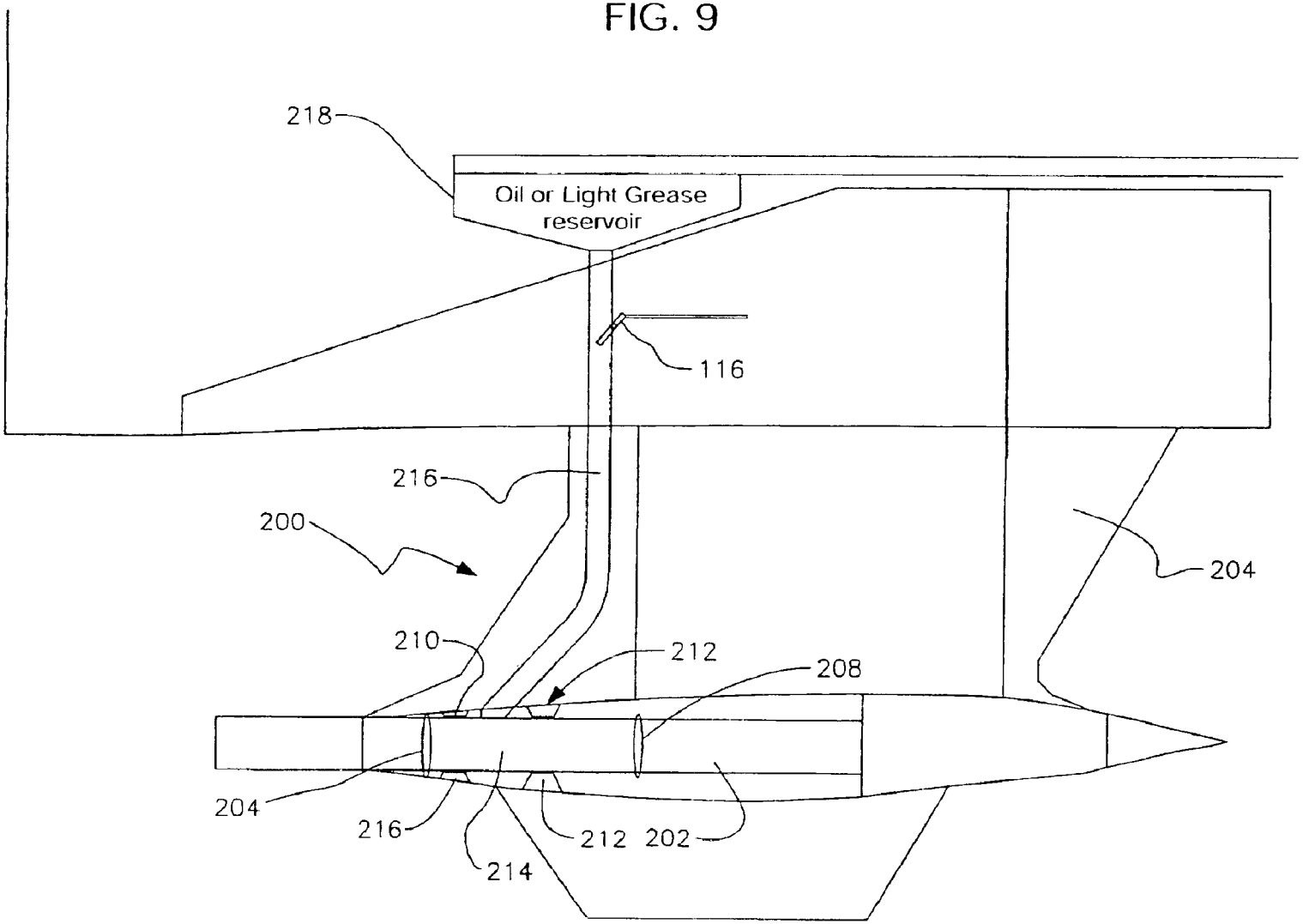
FIG. 9 is a side view of the propulsion unit and seal arrangement in accordance with the preferred embodiment of the invention.

The drive unit is equipped with a novel propeller shaft seal system 200 as shown in FIG. 9. The propeller shaft 202 is mounted in a drive unit 204 with outer and inner water seals (206, 208). Between the outer seal 206 and inner seal 208 are two sets 210, 212 of labyrinth type seals which are spaced apart on the shaft to form a grease cavity 214. A conduit 216 delivers oil or light grease from a reservoir 218 to the grease cavity. When the engine is running, low pressure bleed air is delivered to the reservoir 218 to pressurize heavy oil or light grease in the reservoir 218 and conduit 216 and grease cavity 214. The pressurized oil or light grease always in the grease cavity 214 tends to push any water out of the cavity 214 and keeps the cavity 214 full of grease to displace any water.

Figure 10:
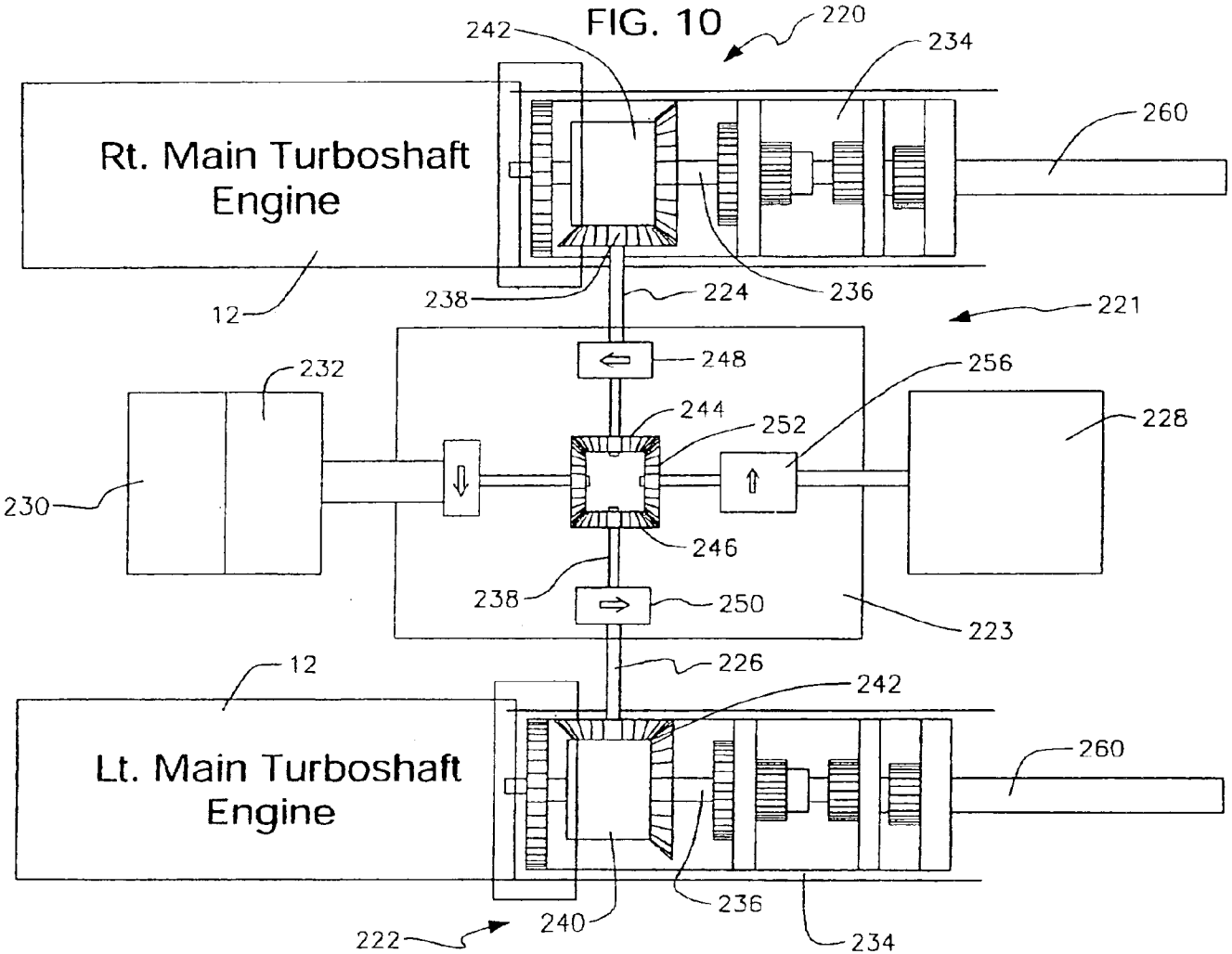
FIG. 10 is a top schematic view of the propulsion unit connected with a power transfer device power in accordance with the preferred embodiment of the invention.

As shown in FIG. 10, an auxiliary drive system 221 permits the main propulsion units 220, 222 to drive an auxiliary electrical power unit 228 through a power transfer device 223. The auxiliary power unit 228 is used to provide electricity for the boat and is typically a 110 volt AC system. A main electrical power unit 230 with a separate engine 232 is connected to the power transfer device so that electricity may be produced when the main power engines 12 are not being operated. The main propulsion units 220, 222 are connected to a power transfer device 223 by auxiliary drive shafts 224, 226. The auxiliary drive shafts 224, 226 are selectively connected to a drive shaft 236 of drive unit 234 by a clutch 240 and a pair of bevel gears 242. The clutches selectively deliver the power of each of the main propulsion units 220, 222 to the power transfer device 223. The auxiliary shafts 224, 226 are selectively coupled to bevel gears 244, 246 by clutches 248, 250 to drive bevel gears 252, 254. The drive bevel gears are connected by coupling devices 256, 258 to the main power unit 230 and auxiliary power unit 228. The coupling device 256 is operable by hydraulic power diverter to deliver a selected rpm to the auxiliary power unit 228 so as to run the power unit 228 at its optimal speed. The power transfer device 223 permits use of one main power unit to drive both shafts 260. Alternatively, one or both main power units may be used to drive the auxiliary power unit 228. Typically, turbine engines are more fuel efficient when run at higher power settings and are not as fuel efficient at low power settings. The power transfer shafts allow the main power units to be powered by auxiliary engine 232 for fuel efficiency during slow speed off-plane operations. The auxiliary engine additionally drives the alternator or alternators. A single turbine at 100% power is much more fuel efficient than two engines at 50% power. The output of the diesel is governed to run at a constant rpm to enable full capacity of the alternator or alternators. A hydraulic coupling with an output control is used with the main propulsion systems to power the auxiliary generator so that the alternator is run at a constant rpm.

Each drive unit can be powered independently by its respective turbine engine for high performance operation. Either turbine engine may also be used to power the second alternator, as a back up should the diesel engine fail. Finally, the auxiliary engine may be connected through the power transfer device to power one or both of the left and right drive units 234 and propellers. Because turbines engines are not particularly efficient at low speeds, the auxiliary engine 232 can be used to drive the boat through the propulsion unit or units at low speeds such as maneuvering in marinas and waterways. At high speed both of the main engines are used to drive the boat.

Having thus described the invention, many modifications and other embodiments are contemplated and within the scope of the invention.

What is claimed is:

1. A marine propulsion assembly for installation into a hull of a boat, said hull having a bottom having an aperture, said marine propulsion assembly comprising:

a base having a top and a lower surface, said base adapted to be mounted in said aperture of said hull with said lower surface having a shape conforming with said bottom of said hull; and a propulsion unit mounted to said base, said propulsion unit having an engine and a drive unit having a propeller shaft and a propeller, a portion of said drive unit extending through an aperture in said base with said propeller outside of said hull, said propulsion unit mounted to said base to be selectively adjustable about a pivot axis wherein said propulsion unit is pivotally mounted to said base such that an angular position of said propeller shaft may be selectively changed during use of said engine to drive the hull.

2. The marine propulsion assembly of claim 1 wherein said engine comprises a turbine having an output shaft.

3. The marine propulsion unit of claim 1 further comprising an exhaust system mounted to said engine, said exhaust system having a cylindrical portion extending on the pivot axis of said engine, said exhaust system further having an exhaust pipe fluidly connected to said cylindrical member to deliver exhaust from said engine to said tubular member.

4. The marine propulsion unit of claim 1 further comprising a rudder mounted to said base.

5. A marine propulsion for a boat having a transom comprising:

a propulsion unit having an engine mounted to a drive unit, said propulsion unit pivotally mounted to said boat with a portion of said drive unit having a propeller extending through an aperture in said transom;

a positioning apparatus for moving said propulsion unit to adjust the angular position of said propulsion unit and said propeller about a pivot axis with respect to a horizontal axis.

6. The marine propulsion unit of claim 5 further comprising a vertical positioning apparatus mounted to said propulsion unit for moving a pivot axis upwardly and downwardly.

7. The marine propulsion unit of claim 5 further comprising a rudder and steering apparatus mounted to said drive unit.

8. A marine propulsion unit for use with a boat comprising:

a housing; and a drive unit having a drive shaft extending on a first plane and propeller shaft extending on a second plane spread apart and parallel to the first plane, and at least two gear shafts having pairs of gears drivingly connecting said drive shaft to said propeller shaft, each of said drive shaft, propeller shaft and pair of gear shafts extending in a spaced apart parallel relationship.

9. The marine propulsion unit of claim 8 further having a hydraulic resistance Circuit connected to the drive unit.

10. A marine propulsion system comprising:

a pair of main engines, each of said main engines connected to a propeller shaft having a propeller;

a auxiliary electrical power device having a motor;

a power transfer device connected to said pair of main engines and said motor of said auxiliary electrical power device, said power transfer device having means for selectively connecting said motor to drive at least one propeller shaft.

11. The marine propulsion system of claim 10, further comprising an auxiliary electrical power generator connected to said power transfer device, said power transfer device having means for selectively driving said auxiliary electrical power generator with one of said pair of main engines.

12. The marine propulsion system of claim 10, wherein said power transfer device is selectively engageable to connect one of said pair of main engines to drive the propeller shaft of an other of said main engines.

13. The marine propulsion unit having:

an engine;

a drive unit, said drive unit having an input shaft carrying at least two gears, said input shaft having a longitudinal bore;

a shift linkage extending through said longitudinal bore and connected to a lever moveable to engage at least one set of drive gears.

14. A marine propulsion comprising:

a turbine engine;

a drive unit connected to said engine, said drive unit having a transmission having an idle position and at least one drive position, said drive unit having a pair of gears, one of said gears connected to a drive shaft, said drive unit further having a hydraulic passage for delivering pressurized hydraulic fluid pressurized by said pair of gears to a restrictor valve when said transmission is in said idle position to place a load on said pair of gears.

15. The marine propulsion unit of claim 14, further having a radiator for cooling said hydraulic fluid.

16. The main propulsion unit of claim 14, further comprising a shift linkage, said shift linkage connected to a valve for delivering fluid from said restrictor valve to a second passage connected to a clutch to release a clutch dog, said linkage further connected to a lever for engaging a set of gears for driving a propeller shaft.

17. A marine propulsion assembly for installation into a hull of a boat, said hull having a bottom having an aperture, said marine propulsion assembly comprising:

a base having a top and a lower surface, said base adapted to be mounted in said aperture of said hull with said lower surface having a shape conforming with said bottom of said hull; and a propulsion unit mounted to said base, said propulsion unit having an engine and a drive unit having a propeller shaft and a propeller, a portion of said drive unit extending through an aperture in said base with said propeller outside of said hull, said propulsion unit pivotally mounted to said hull such that an axis of rotation for said shaft may be selected.

* * * * *